United States Patent [19]

Bevelacqua

[11] Patent Number: 4,590,722

[45] Date of Patent: May 27, 1986

[54] UNIQUE IMPROVED DRAINAGE SYSTEM FOR BASEMENTS

[76] Inventor: Joseph Bevelacqua, Akron, Ohio

[21] Appl. No.: 665,947

[22] Filed: Oct. 29, 1984

[51] Int. Cl.[4] ..... E02D 19/00

[52] U.S. Cl. ..... 52/169.5; 138/92; 138/162

[58] Field of Search ..... 52/169.5, 169.14, 303; 405/36,229,284; 138/92, 156, 157, 162

[56] References Cited

U.S. PATENT DOCUMENTS

| | | | |
|---|---|---|---|
| 1,683,544 | 9/1928 | Hansen | 138/157 |
| 2,921,607 | 1/1960 | Caveney | 138/157 |
| 3,888,087 | 6/1975 | Bergsland | 405/36 X |
| 4,333,281 | 6/1982 | Scarfone | 52/169.5 |

FOREIGN PATENT DOCUMENTS

| | | | |
|---|---|---|---|
| 2002971 | 2/1979 | United Kingdom | 138/157 |

*Primary Examiner*—Henry E. Raduazo
*Assistant Examiner*—John M. White
*Attorney, Agent, or Firm*—Oldham, Oldham & Weber Co.

[57] ABSTRACT

A drainage apparatus for basements includes a conventional block or poured concrete wall supported by a footer having an excavation at its inner side extending to the same level as the lower part of the footer, with an aperture and drain tile positioned in the excavation and extending the length thereof. A cover plate means extends from the drain pipe over to the wall for end support on an inner ledge means on the block wall, whereby a floor section can be laid over the cover plate and drain tile to blend into the remainder of the basement floor.

6 Claims, 4 Drawing Figures

UNIQUE IMPROVED DRAINAGE SYSTEM FOR BASEMENTS

BACKGROUND ART

Reference is made to my own prior U.S. Pat. No. 3,287,866 upon an improved foundation and wall drainage system including a drainage tile positioned adjacent the inner wall of the footer of the outer block wall-footer construction in a conventional basement wall. The basement wall has drain openings provided in the inner wall of the block wall whereby water seeping into the block wall center openings can flow out to a gravel bed and down to a drain tile embedded in the gravel bed and positioned adjacent the footer. However, these drain tile and gravel bed in the prior units can get blocked with silt, or dirt. Normally gravel is placed around the drain tile to allow entry of the water into the drain tile. However, the chemicals in the water will stick to the gravel and, in time, not let the water pass through the pipe. These chemicals can be iron or lime in the water or chemicals on the surface of the rock. That is, the system has worked well but the material used for filling around the footer and foundation wall may become tightly packed and sand and gravel may pack into any original open areas adjacent the footer-drain tile area and tend to slow down or prevent good drainage through the system.

I also refer to my copending patent application, Ser. No. 535,157 relating to an improved wall and foundation drainage construction and utilizing a drainage member secured to or positioned on an upper inner surface of the footer and connecting to drainage openings provided in a bottom block of the wall and extending out to gravel means associated with the drain tile and an improved action can be obtained from a construction of that type which aids in the flow of water to the drain tile means provided.

Yet another type of a construction is shown in U.S. Pat. No. 3,283,460 wherein a protector strip of generally L-shape in vertical section is positioned on the inner corner of a wall and foundation unit to aid in sealing the connection therebetween, but to permit drainage from the wall thereunder down to an associated drain tile unit. A drain tile, is positioned on a basement floor and is operatively connected to the wall-foundation unit at the lower inner surface thereof, as shown in U.S. Pat. No. 3,304,672 but this type of a drainage tile means is unsightly and is exposed to damage by not being covered in the wall-foundation unit. Further, relative to the piping system of this patent which is placed upon the floor, this system will not work for various reasons. The cement used will come loose in time, as there is no cement which will permanently adhere where water is constantly present. In addition, since the unit is placed upon the floor, there is always that half of the block under the floor which will never drain, resulting in the constant presence of corrosive water and musty odors.

In poured concrete basements, water will penetrate between the footer and the wall due to the pressure existing on the outside of the wall and footer. This new inside drainage system allows water to move freely into the pipe.

The general object of the present invention is to provide a new and improved block wall and foundation drainage construction apparatus wherein an open drainage area is provided immediately adjacent an inner wall of the footer of the wall-foundation unit.

Another object of the invention is to provide an improved drainage tile in a foundation drainage assembly wherein the drainage tile can be molded from plastic or other extrudable material and wherein drain apertures can be provided in a lower portion thereof and a reinforcing or support flange can be provided thereon on an upper portion of the drainage tile.

Another object of the invention is to provide a drainage tile which can be molded in a plurality of pieces and be readily assembled into an open centered drainage unit, and to have an upper shelf provided on the drainage tile and position it at and above an open area provided adjacent the footer and which support shelf connects to the block wall above drainage openings provided therein.

Other objects of the invention are to provide a novel and improved hollow centered drainage means, to support a cover plate or support shelf of a drain tile assembly in a unique manner in a basement drainage system; to utilize conventional members in making up a block wall-footer unit and to form an efficient, long lived drainage means for a basement which is competitive in price and which will provided long service life.

In general the present invention relates

- a foundation wall and drainage tile system which comprises
- a footer, an inner wall of the footer having an open area extending therealong,
- a wall formed of hollow building blocks with openings in their upper and lower surfaces and arranged vertically on the footer, the lower most row of the building blocks having space and portions in the inner wall surfaces thereof communicating with the interior of the hollow building blocks to form drainage openings adjacent to the open area provided, and
- a basement floor is present and is above the drainage openings, and a drain means including a hollow center portion having a plurality of drain slots formed in a lower area thereof is positioned in the open area provided adjacent the footer, and
- a plate means bridging over said open area and supported on the drain means and a part of the blocks above the drainage openings whereby the plate means can support a marginal portion of the basement floor thereon.

Attention is now particularly directed to the accompanying drawings, wherein.

Figure 3:
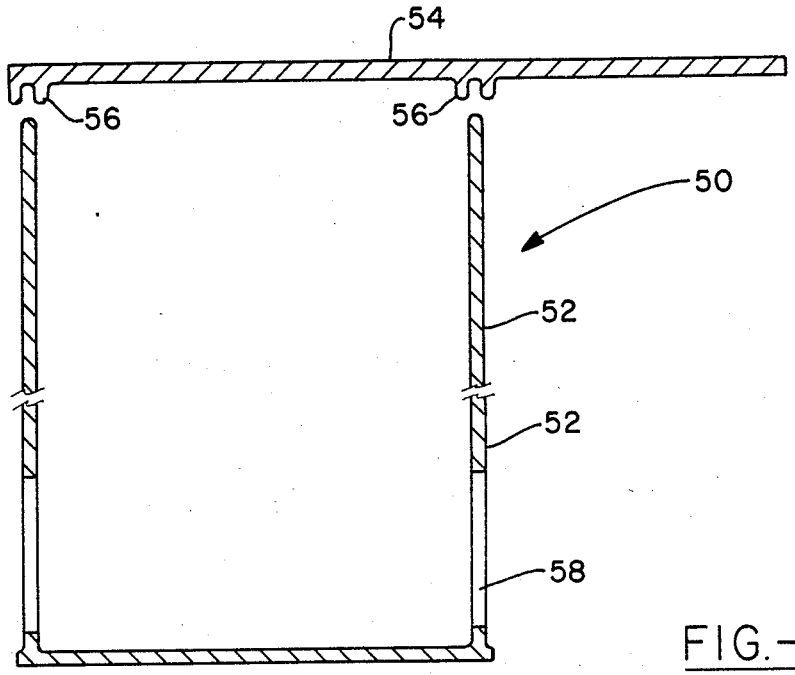
Figure 4:
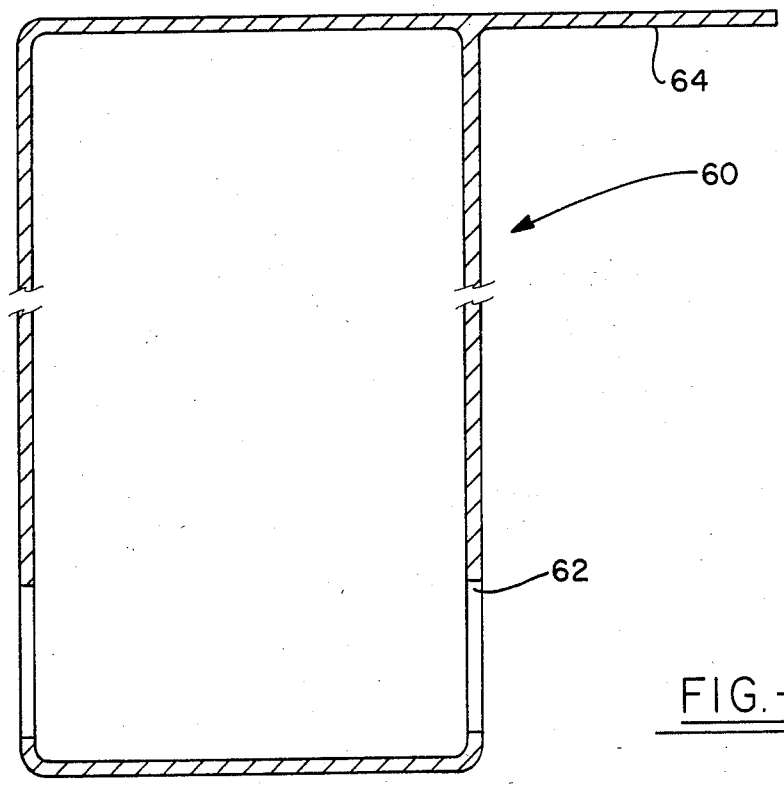

FIG. 3. is a fragmentary enlarged vertical section through a drain tile or tube of the invention; and FIG. 4 is a vertical section through a modified drain tile of the invention.

When referring to corresponding members shown in the specification and referred to in the drawings, corresponding numerals are used to facilitate comparison therebetween.

BEST MODE FOR CARRYING OUT THE INVENTION

Figure 1:
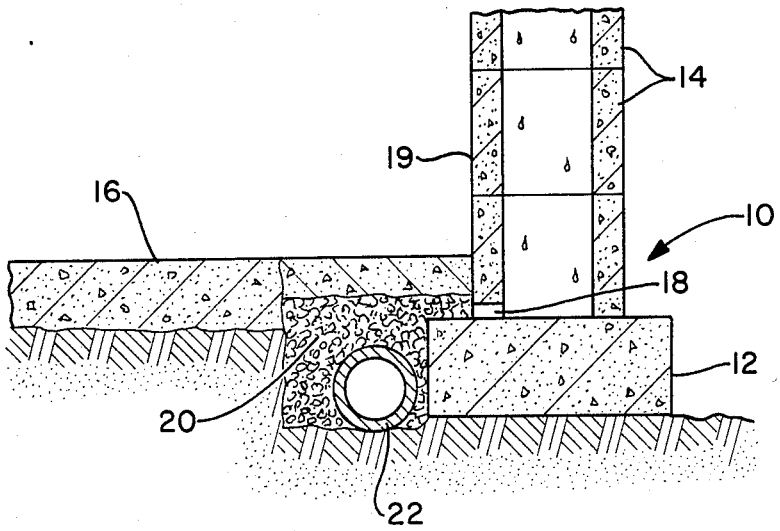
FIG.-1 Prior Art
FIG. 1 is a fragmentary section of the portion of the basement wall and floor showing it in sections and reflecting current prior art teachings.

Attention is now particularly directed to the details of the construction shown in the accompanying drawing, and FIG. 1 shows a known type of a wall and foundation drainage construction indicated as a whole by the numeral 10 and including a footer 12 and hollow center of the building blocks 14 arranged in a conventional manner on the footer. A basement floor 16 is provided on the inner surface of the wall 10 and this wall has suitable openings or slots 18 provided in an inner wall portion 19 of the building block whereby any water or moisture collecting in the hollow centers of the blocks 14 can flow downwardly of the vertically aligned open centers thereof the water then flows from the wall through the holes 18 and this moisture then can flow to and through the gravel bed 20 provided adjacent the footer 12. A drain tile 22 is positioned in the open area provided adjacent the footer 12 but which area is filled by the gravel 20 and tile 22. The basement floor 16 extends over this gravel 20 and forms a permanently closed unit for the drain tile and associated means.

In accordance with the present invention, an improvement has been provided in that an open area is provided adjacent a drain tile means and continued clearance of the open area for flow of water from the basement is assured by the present invention.

Figure 2:
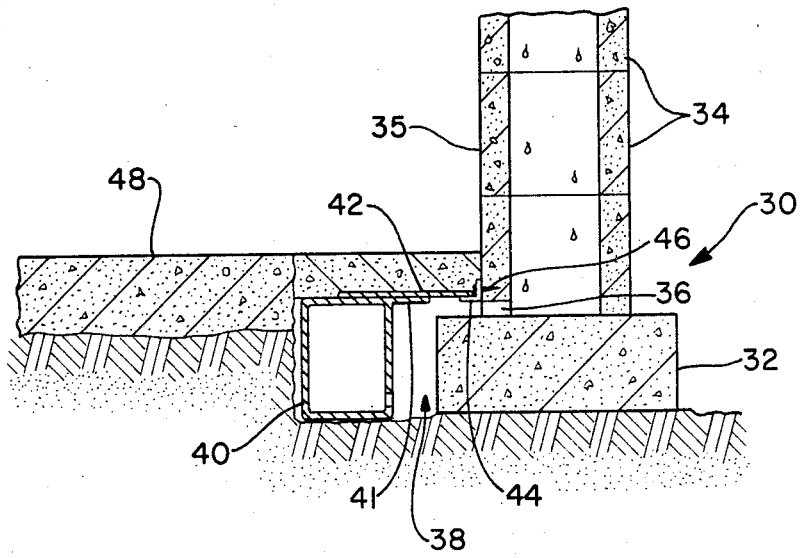
FIG. 2 is a fragmentary vertical section of a basement wall-floor combination embodying the principles of the present invention.

Thus, in FIG. 2 a conventional wall and foundation drainage assembly 30 is shown and it has a footer 32 provided therefore and building blocks 34 make up this wall 30 in a conventional manner, the blocks 34 having open centers vertically aligned in the wall whereby any moisture coming into the center portion of the wall will flow down therethrough and can be drained from the wall through a plurality of openings or slots 36 that are formed in an inner wall so that these portions in the inner wall surfaces of the blocks communicate from the interior of the building blocks to form drainage openings adjacent an open area 38 which is formed in any suitable manner adjacent the inner wall of the wall footer 32. Now, water thus can flow out through the slot 36 over the upper surface of the footer and down into this open area 38.

One of the features of the invention is that a hollow center drain means particularly a rectangular shaped tile 40 is provided to form an elongate tube or member extending the length of the wall 30 in a conventional manner and serving to provide a drainage opening therefore. This drain tile 40 may have a support shelf 41 extending from the top portion thereof in a lateral direction and aid in supporting a bridge plate 42 that extends from an upper portion of the drain tile over to and is supported on a lower part of the wall 30. Thus, FIG. 2 shows that a support angle 44 can be suitably secured to the inner wall 35 of the blocks above the slot or drainage openings 36 provided therein. The angle can be secured in any known manner to the blocks 34 in the wall and a cement nail 46 is one typical means that could be used for securing the angle 44 in position. Preferably however, a plastic rivet 46 is used to secure the angle 44 in position. A plastic, rather than metal rivet, is used since it will not be affected by moisture. If any type of metal is used to fasten the angle to the wall, it will, in time, rust and deteriorate. The plate 42 is horizontally positioned.

After the support plate 42 has been positioned, then a final portion of a basement floor 48 can be poured and basement floor 48 will extend over the drainage tile 40 and over the plate 42 to give the finished appearance to the unit. However, at the same time, the open area 38 is maintained and water flowing down through the wall can collect in the drain tiles 40 and flow from the basement in a conventionl manner.

It will be appreciated that the drain tile can be made of any suitable material and can be formed of suitable length members. For example, the drain tile can be made from ceramic material or it could be molded from plastic as desired.

FIG. 3 particularly shows a drain tile 50 that is formed from a U-shaped lower section 52 and a top plate 54. This top plate 54 preferably has two pairs of downwardly extended directed lugs or flanges 56 forming a confining means for the upper end of the longitudinally extending wall of the drain tile. The plate 54 does extend laterally from the tile any desired distance. The tile 50 of course has any suitable sized drain openings 58 formed therein adjacent the lower portion thereof. The top plate 54 can be suitably secured to the lower section as by friction or by a cement or otherwise as desired to make a permanent bond between the lower section 52 and the cover or top plate 54. These tile sections can be assembled, of course, prior to their installation in a basement drain assembly.

A second type of a tile 60 is shown in FIG. 4 wherein in this instance the tile 60 is of unitary construction and it has drain openings 62 formed in the lower part thereof and, it likewise, has a support flange or plate 64 extending laterally in one direction from an upper portion of this tile. The tiles 50 and 60 and usually those of the drain tile 40 preferably are formed of substantially box shape in vertical section with an open center being provided in the tile to facilitate drainage action.

The open area or excavation provided adjacent the footer of the wall 30 is easily formed and drain means can be readily assembled in association therewith and have the basement floor trimmed up or completed to abut against the inner wall of the wall unit 30 to provide a finished construction within the basement. However, a very effective, long lived drainage means has been provided at the margins of the basement walls and effective drainage action should be provided for a long time by this price competitive readily assembled type of a wall and foundation means of the invention.

While in accordance with the patent statutes only the best mode and preferred embodiment of the invention has been set forth, it is understood that for a true scope and breadth of the invention, reference should be made to the appended claims.

What is claimed is:

1. A foundation wall and drainage tile system comprising a footer, a wall formed of hollow building blocks having openings in their upper and lower surfaces arranged vertically on said footer, the lowermost row of said building blocks having spaced portions in the inner wall surfaces thereof communicating with the interiors of said hollow building blocks and forming drainage openings adjacent an open area, a basement floor extending to said blocks and connecting thereto above said drainage openings, and wherein the improvement comprises an inner wall of said footer having said open area extending therealong, a drain means comprising a hollow member having a plurality of drain openings formed in a lower portion thereof positioned in said open area, and a substantially horizontal plate means bridging over said open area and supported on said drain means and a part of said blocks above said drainage openings, said drain means constructed so as to have a supporting shelf for said plate means and said open area being free of gravel and other filler means.

2. A foundation wall and drainage system as in claim 1, where said drain means and open area extend the length of the footer and said drain means has a support shelf extending laterally therefrom at the upper margin thereof and supporting said plate means, said drain means being rectangular in vertical section.

3. A drainage apparatus for a basement having a block outer wall and footer unit and a floor and including said outer wall and footer unit having an open area excavation at the inner margin thereof extending from the lower margin of said wall footer unit up to a level above said footer; said open area being free of gravel and other filler means; said outer wall having vertically extending openings therein that are aligned, an apertured drain pipe having a support shelf in said excavation and being spaced from said footer, said outer wall draining water therefrom into said excavation, said drain pipe enabling water to flow therethrough from said excavation, a support means secured to said outer wall on its inner surface at a level above said footer, and a substantially horizontal cover plate means bridging over a part of said excavation and connecting said drain pipe to said support means, a portion of said floor being supported by said cover plate.

4. An apparatus as in claim 3 where said drain pipe is apertured and is formed of sections operatively connected together and each pipe section is of open center rectangular shape in vertical section with a flat reinforcing flange protruding laterally from a top portion thereof.

5. An apparatus as in claim 4 where said pipe section is a two part molded unit including a U-shape lower member and a top member, engagable with the upper end of said lower member, including said reinforcing flange, said top member, having dependant receptor means for engaging said lower member upper end.

6. A foundation wall and drainage tile system as in claim 1 wherein said open area has a bottom surface supporting said drain means, said bottom surface being substantially level with the lower surface of said footer.

* * * * *